US011419428B2

(12) United States Patent
Paoutoff

(10) Patent No.: US 11,419,428 B2
(45) Date of Patent: Aug. 23, 2022

(54) LIFT-UP BED STRUCTURE WITH RETRACTABLE SEAT SUPPORT

(71) Applicant: Alexis Paoutoff, La Cadiere d'Azur (FR)

(72) Inventor: Alexis Paoutoff, La Cadiere d'Azur (FR)

( * ) Notice: Subject to any disclaimer, the term of this patent is extended or adjusted under 35 U.S.C. 154(b) by 481 days.

(21) Appl. No.: 16/091,933

(22) PCT Filed: Apr. 4, 2017

(86) PCT No.: PCT/EP2017/057922

§ 371 (c)(1),
(2) Date: Oct. 5, 2018

(87) PCT Pub. No.: WO2017/174543

PCT Pub. Date: Oct. 12, 2017

(65) Prior Publication Data

US 2019/0116985 A1 Apr. 25, 2019

(30) Foreign Application Priority Data

Apr. 8, 2016 (FR) ..... 1653093

(51) Int. Cl.
*A47C 19/22* (2006.01)
*A47C 17/165* (2006.01)
*A47C 17/38* (2006.01)

(52) U.S. Cl.
CPC ..... *A47C 19/22* (2013.01); *A47C 17/165* (2013.01); *A47C 17/38* (2013.01)

(58) Field of Classification Search
CPC ..... A47C 17/04; A47C 17/40; A47C 17/38; A47C 19/205; A47C 17/52; A47C 19/22; A47C 17/165
See application file for complete search history.

(56) References Cited

U.S. PATENT DOCUMENTS 1,609,746 A * 12/1926 Vittone ..... A47C 17/40 5/43
5,652,978 A 8/1997 Wiig

FOREIGN PATENT DOCUMENTS

CN 201468624 U 5/2010
FR 2882634 A1 * 9/2006 ..... A47C 17/48
WO 2013/156141 A1 10/2013

OTHER PUBLICATIONS

International Search Report dated Jun. 22, 2017, issued in corresponding International Application No. PCT/EP2017/057922, filed Apr. 4, 2017, 4 pages.

* cited by examiner

*Primary Examiner* — David R Hare
*Assistant Examiner* — Adam C Ortiz
(74) *Attorney, Agent, or Firm* — Christensen O'Connor Johnson Kindness PLLC

(57) ABSTRACT

A lift-lip bed structure comprising: a fixed frame (2); a pivoting frame (5) capable of supporting bedding, mounted pivoting about a transverse pivot axis (6) such that the pivoting frame can pivot between a horizontal position extending forwards and a rear vertical raised position; and a movable support (23) capable of supporting a seat, mounted movable on the fixed frame (2) such that the movable support (23) can be moved between a high advanced position and a low retracted position in which it is lower than in the high advanced position; the movable support (23), in the advanced position, extending at least partially forward of the pivoting frame (5), in the raised position, and the movable support (23), in the retracted position, extending at least partially below and at a distance from the pivoting frame (5), in the extended position.

5 Claims, 6 Drawing Sheets

LIFT-UP BED STRUCTURE WITH RETRACTABLE SEAT SUPPORT

The present invention relates to the field of furniture and more particularly that of lift-up beds.

The patent WO 2013/156141 describes a lift-up bed which comprises a fixed framework which bears a raisable pivoting framework capable of bearing a mattress. This bed comprises a mobile support which is borne in an articulated manner by first arms fixed to the pivoting framework and by second arms articulated on the fixed framework, the first arms inducing the movements of the mobile framework during the pivoting of the pivoting framework.

A lift-up bed structure is proposed which comprises a fixed framework; a pivoting framework capable of supporting bedding, mounted to pivot on a transverse pivoting axis in such a way that the pivoting framework can pivot between a horizontal position stretched out forward and a rear vertical raised position; and a mobile support capable of supporting a seat, movably mounted on the fixed framework in such a way that the mobile support can be displaced between a high advanced position and a low retracted position in which it is lower than in the high advanced position; the mobile support, in advanced position, extending at least partly in front of the pivoting framework, in raised position, and the mobile support, in retracted position, extending at least partly below and at a distance from the pivoting framework, in stretched-out position.

The lift-up bed structure comprises guiding means which determine the travel of the mobile support relative to the fixed framework between its high advanced position and its low retracted position and link means, distinct from the guiding means, linking the pivoting framework and the mobile support and capable of displacing the mobile support from its advanced position to its retracted position when the pivoting framework is pivoted from its raised position to its stretched-out position, and vice versa, along said travel.

The guiding means can comprise guides mounted on the fixed framework and rollers or runners mounted on the mobile support and cooperating with the guides.

The guides can have horizontal front terminal portions.

The link means between the pivoting framework and the mobile support can comprise at least one arm articulated on the one hand on the pivoting framework and on the other hand on the mobile support.

The articulated arm can be linked to the mobile support by a transverse pivot and can have a travel compensation opening in which is engaged a transverse pivot borne by the pivoting framework.

The pivoting framework can be equipped with a cladding facing plate, the mobile support, in retracted position, extending at least partly below and at a distance from this cladding plate of the pivoting framework, in stretched-out position.

The fixed framework can comprise a front cross member forming an abutment for the pivoting framework, in stretched-out position.

The fixed framework can have supports on the floor such that it is self-supporting.

The structure can comprise lateral flanges linked by a reinforcing and anti-torsion cross member situated below and in front of the transverse pivoting axis of the pivoting framework.

The structure can comprise at least one cylinder between the pivoting framework and said reinforcing and anti-torsion cross member.

A lift-up bed structure, with raisable mattress and with retractable seat, will now be described by way of nonlimiting exemplary embodiment, illustrated by the drawing in which.

Figure 2:
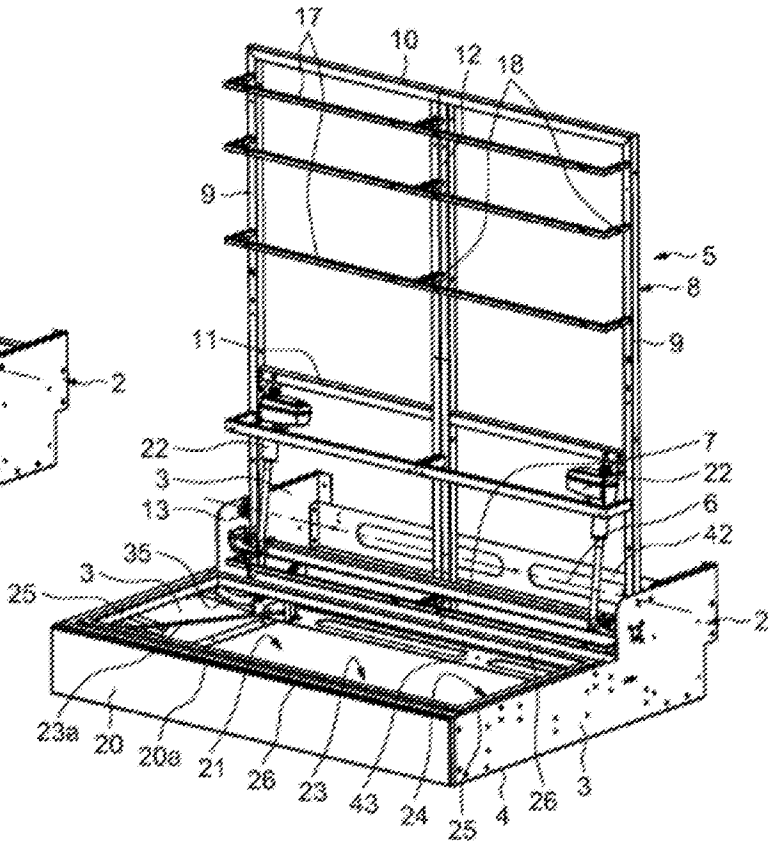
FIG. 2 represents a perspective view of the bed structure, in raised position, with neither mattress nor seat.

The lift-up bed structure 1 comprises a fixed framework 2 which comprises two opposite lateral flanges 3 spaced apart transversely, which have horizontal bottom edges 4 intended to rest on the floor.

The lift-up bed structure 1 comprises a pivoting framework 5 which has a part engaged between the lateral flanges 3 and which is mounted to pivot on these lateral flanges 3 on a transverse pivoting axis 6, in such a way that the pivoting framework 5 can pivot between a stretched-out position in which it extends substantially horizontally and a rear raised position in which it is disposed substantially vertically.

According to the present description, the stretched-out position of the pivoting framework 5 is a reference position in which a longitudinal direction between the front and the rear and a transverse direction at right angles to this longitudinal direction are established.

Figure 1:
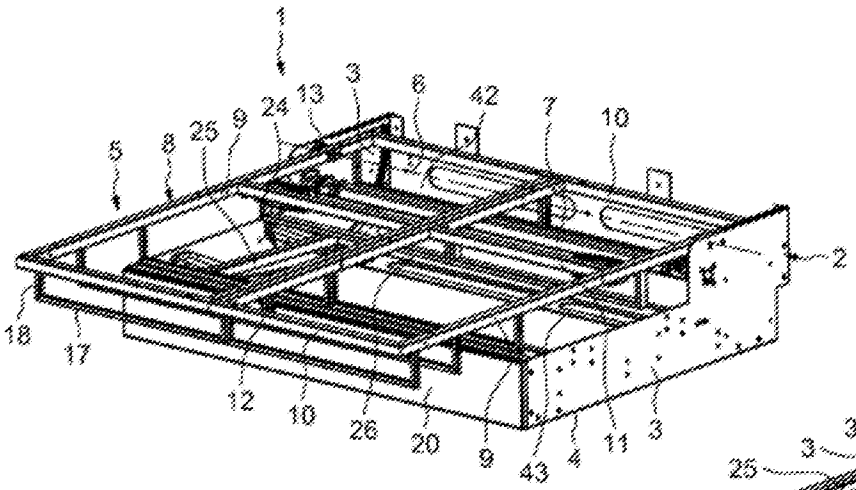
FIG. 1 represents a perspective view of the bed structure, in stretched-out position, with neither mattress nor seat.
Figure 4:
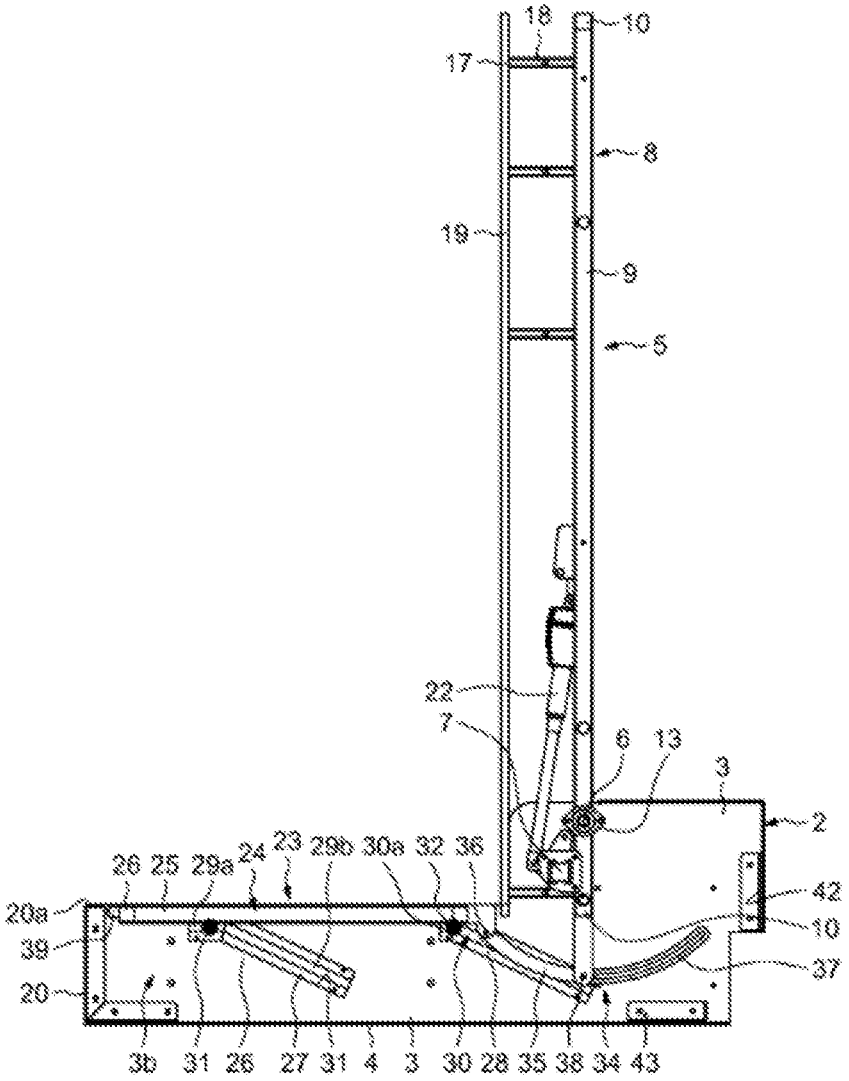
FIG. 4 represents a longitudinal cross section of the bed structure, in raised position, with neither mattress nor seat.
Figure 5:
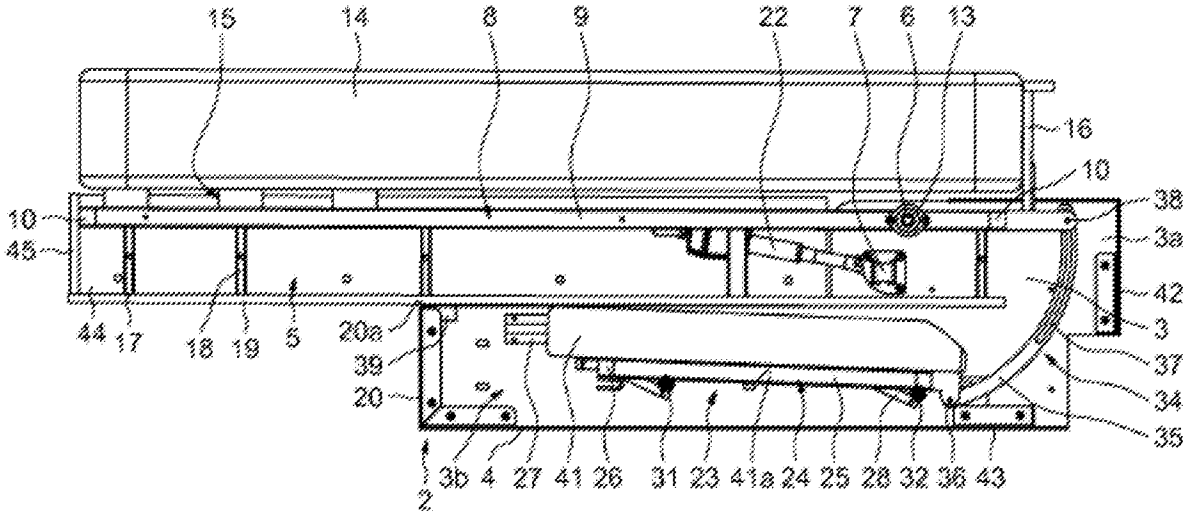
FIG. 5 represents a longitudinal cross section of the bed structure, in stretched-out position, with mattress and seat.
Figure 6:
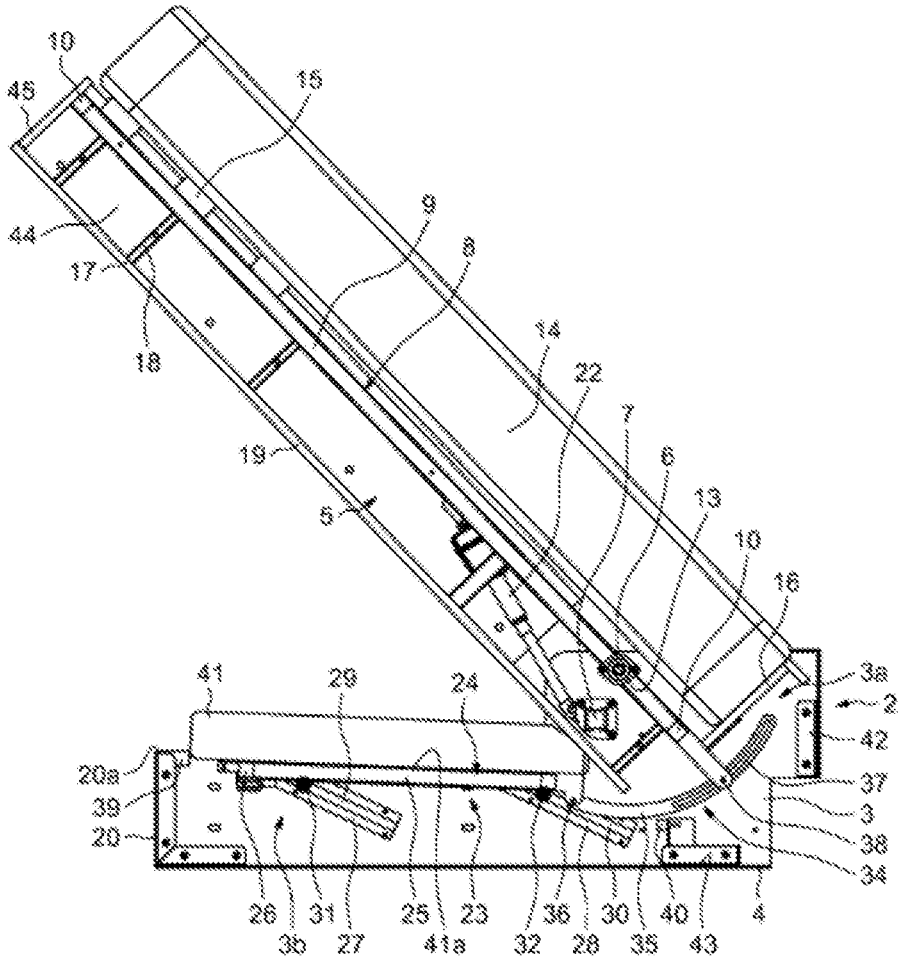
FIG. 6 represents a longitudinal cross section of the bed structure, in an intermediate raised position, with mattress and seat.

When the pivoting framework 5 switches from its raised position (FIGS. 2, 4 and 7) to its stretched-out position (FIGS. 1, 3 and 5), the pivoting framework 5 is pivoted forward, its so-called "front" or "foot" part switching from a high position to a low position and its so-called "rear" or "head" part, engaged between the lateral flanges 3, pivoting on the transverse pivoting axis 6 relative to the lateral flanges 3.

The fixed framework 2 comprises a link cross member 7 whose ends are secured to the lateral flanges 3. The link cross member 7 is disposed below and in front of the transverse pivoting axis 6. The link cross member 7 also constitutes a reinforcing and anti-torsion member. For example, the link cross member 7 is formed by a structural bar of square, rectangular, round, T-shaped or similar section, provided at its ends with plates fixed onto the opposing faces of the lateral flanges 3 by screws.

The pivoting framework 5 comprises a substantially rectangular frame 8 which comprises opposing lateral stringers 9 and opposing transverse bars 10 linking the ends of the lateral stringers 9, and intermediate bars 11 and 12, forming a cross and linking the centers of the lateral stringers 9 and of the transverse bars 10.

To ensure that the pivoting framework 5 is mounted so as to pivot on the fixed framework 2, transverse pivots 13 disposed along the transverse pivoting axis 6 are interposed between the lateral stringers 9 and the lateral flanges 3, these transverse pivots 13 being provided at short distances from the rear transverse bar 10 of the frame 8 given the length of the lateral stringers 9.

When the pivoting framework 5 is in stretched-out position (FIGS. 1, 3 and 5), the frame 8 goes above and at a short distance from the link cross member 7. When the pivoting framework 5 is in raised position (FIGS. 2, 4 and 7), the frame 8 goes behind the link cross member 7, the latter being able to constitute an end-of-travel abutment.

The pivoting framework 5 is capable of supporting, for example on the top face of the frame 8 and of the crossed bars 11 and 13, a mattress 14 via, for example, a slatted base 15. The mattress 14 and the slatted base 15 can be held by straps (not represented) and by a rear transverse plate 16 of the pivoting frame 5 against which the rear extent of the mattress 14 comes to bear.

The pivoting framework 5 comprises bottom transverse bars 17 whose ends are linked to the stringers 9 and to the intermediate bar 12 by offsetting bars 18.

The pivoting framework 5 is provided with a cladding plate 19 fixed onto the transverse bars 17. The cladding plate 19 extends parallel to and at a distance from the frame 8 and covers the surface of this frame 8.

When the pivoting framework 5 is in stretched-out position (FIGS. 1, 3 and 5), the cladding plate 19 extends below the bottom transverse bars 17 and goes below and at a distance from the link cross member 7.

When the pivoting framework 5 is in raised position (FIGS. 2, 4 and 7), the cladding plate 19 extends as a facing and goes in front of and at a distance from the link cross member 7.

When the pivoting framework 5 is in stretched-out position (FIGS. 1, 3 and 5), the cladding plate 19 bears on the top edge 20*a* of a front cross member 20 linking the lateral flanges 3 and situated in front of the transverse articulation axis 6 and of the link cross member 7, the cross member 20 forming a downward end-of-travel abutment for the pivoting framework 5. Preferably, one of the cross members 17 bearing the cladding plate 19 is situated above the top edge 20*a* of the cross member 20.

For example, the cross member 20 can be formed by a vertical plate whose ends are secured to the vertical front edges of the lateral flanges 3, this plate being able to be reinforced by L-shaped folds.

When the pivoting framework 5 is in raised position (FIGS. 2, 4 and 7), the cross member 20 is situated in front of the cladding plate 19, in such a way that there is an upwardly open free space 21 between the cladding plate 19 and the cross member 20 and between the lateral flanges 3.

In order to make the pivoting framework 5 pivot relative to the fixed framework 2, also provided are lateral actuation cylinders 22, for example electrical, gas or spring cylinders 19, which are mounted between the link cross member 7 and the stringers 9 of the pivoting framework 5, on which they are transversely articulated.

The lift-up bed 1 further comprises a mobile support 23 disposed at least partly in the free space 21 and movably mounted on the fixed framework 2 in such a way that the mobile support 23 can be displaced between a high advanced position, corresponding to a position of use, and a low retracted position (FIGS. 1, 3 and 5), corresponding to a retracted position, in which it is lower than in the advanced position.

Over at least a part of its travel from its high advanced position to its low retracted position, the mobile support 23 retracts backward while lowering. Conversely, over at least a part of its travel from its low retracted position to its high advanced position, the mobile support 23 advances forward while rising.

The mobile support 23, in advanced position, extends at least partly in front of the pivoting framework 5, in raised position, and the mobile support 22, in retracted position, extends at least partly below and at a distance from the pivoting framework 5, in stretched-out position.

The mobile support 23 comprises a rectangular frame 24 which comprises lateral stringers 25 and transverse bars 26 linking the ends of the stringers 25.

The flanges 3 are provided, on their opposing faces, with two pairs of opposing guides 27 and 28, offset longitudinally, forming opposing pairs of guiding grooves 29 and 30.

The lateral stringers 25 are provided laterally with opposing rollers 31 and 32 engaged in the guiding grooves 29 and 30. These rollers could be replaced by runners mounted on the stringers and possibly articulated on these stringers 25 on transverse axes.

The guiding grooves 29 and 30 are arranged as follows.

With the pivoting framework 5 in raised position (FIGS. 2, 4 and 7), the rectangular frame 24 of the mobile support 23 extends, in its high advanced position, substantially horizontally between the top part of the plate forming the front cross member 20 of the fixed framework 2 and the bottom part of the cladding plate 19 of the pivoting framework 5. The rectangular frame 24 of the mobile support 23 therefore extends in front of the bottom part of the pivoting framework 5, in front of the link cross member 7 of the fixed framework 2 and at a level situated below this link cross member 7.

The frame 24 is dimensioned in such a way that the stringers 25 are at a short distance from the opposing guides 27 and 28 and the transverse bars 26 are at a short distance from the cladding plate 19 and from the front cross member 20.

With the pivoting framework 5 in stretched-out position (FIGS. 1, 3 and 5), the rectangular frame 24 of the mobile support 23, in its low retracted position, is offset backward and downward relative to its high advanced position and extends substantially horizontally, or slightly inclined backward, below and at a distance from the cladding plate 19, and therefore below and at a distance from the pivoting framework 5 and more particularly below the link cross member 7 of the fixed framework 2.

The guiding grooves 29 and 30 and the rollers 31 and 32 constitute sliding guiding means. The guiding grooves 29 and 30 determine the sliding travels of the rollers 31 and 32 and have short, horizontal front terminal portions 29*a* and 30*a* followed by portions 29*b* and 30*b* that are inclined backward and downward.

In the high advanced position of the rectangular frame 24 of the mobile support 23 (FIGS. 3 and 5), the rollers 31 and 32 are at points of horizontal front terminal portions 29*a* and 30*a* of the guiding grooves 29 and 30 such that the mobile support 23 is capable of supporting vertical loads, without inducing horizontal displacements.

From its high advanced position (FIGS. 4 and 7), the mobile support 23 can be displaced backward over a horizontal travel, determined by the short, horizontal front terminal portions 29*a* and 30*a*, then be displaced substantially parallel to itself over a travel that is inclined backward and downward, the mobile support 23 retracting while lowering to reach its low retracted position.

The lift-up bed 1 further comprises link means 34, distinct from said guiding means, which link the pivoting framework 5 and the mobile support 23. These means 34 are capable of displacing the mobile support 23 from its high advanced position (FIGS. 4 and 7) to its low retracted position (FIGS.

3 and 5) when the pivoting framework 5 is pivoted from its raised position to its stretched-out position, and vice versa.

The link means 34 comprise opposing lateral arms 35 which are articulated on the one hand on the mobile support 23 and on the other hand on the pivoting framework 5.

The articulated lateral arms 35 are mounted to rotate on short backward extensions of the stringers 25 of the mobile support 23 via transverse pivots 36 and have, in their lengthwise direction, travel compensation openings 37 in which are engaged transverse pivots 38 borne by backward extensions of the stringers 9 of the pivoting framework 5.

The articulated lateral arms 35 are arched, their concave form being on the side of the rear part of the pivoting framework 5.

When the pivoting framework 5 is in its stretched-out position (FIGS. 1, 3 and 5) and the mobile support 23 is in its high advanced position, the pivots 38 are situated at the end of the travel compensation openings 37 closest to the pivots 36, in a close position.

When the pivoting framework 5 is in its raised position (FIGS. 2, 4 and 7) and the mobile support 23 is in its low retracted position, the pivots 38 are situated at the end of the travel compensation openings 37 furthest away from the pivots 36, in a distant position.

When the pivoting framework 5 is pivoted from its stretched-out position (FIGS. 1, 3 and 5), in a first portion of angular travel, the pivots 38 are displaced along the travel compensation openings 37, from their distant position to their close position. Then, in a second portion of angular travel, the pivoting framework 5 drives the mobile support 23 from its low retracted position to its high advanced position when it reaches its raised position (FIGS. 2, 4 and 7).

Figure 7:
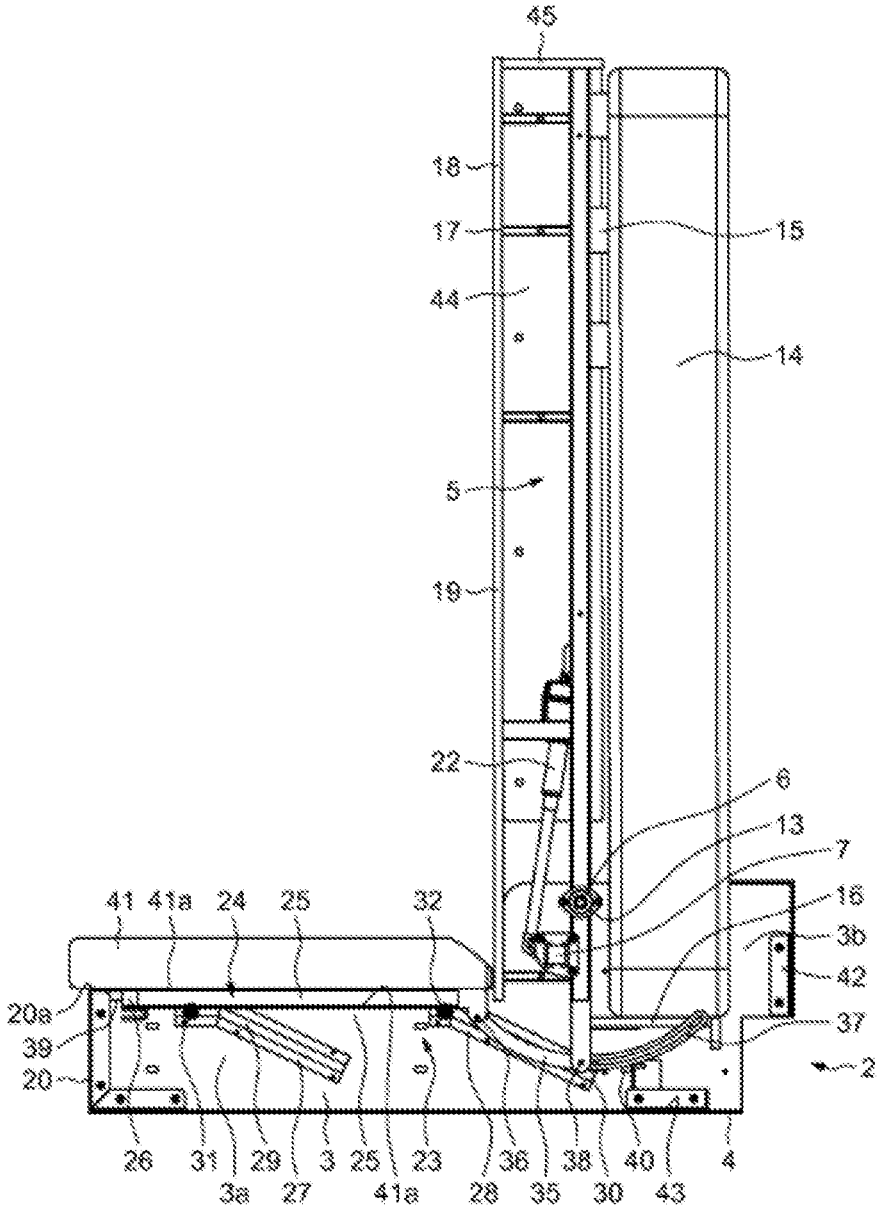
FIG. 7 represents a longitudinal cross section of the bed structure, in raised position, with mattress and seat.

The high advanced position of the mobile support 23 can be limited by front lateral abutments 39 of the fixed framework 2 and the low retracted position of the mobile support 23 can be limited by rear lateral abutments 40 of the fixed framework 2 (FIG. 7).

The mobile support 23 is capable of supporting a seat 41 via a slatted base 41*a*, or the like, borne by the frame 24. The seat 41 can be formed by a seating cushion or several transversely adjacent seating cushions, of substantially parallelepipedal forms.

The movements described above of the pivoting framework 5 and of the mobile support 23 are designed for the seat 41 to occupy a position of use in front of the cladding plate 19 when the pivoting framework 5 is in its raised position (FIGS. 2, 4 and 7) and the mobile support 23 is in its high advanced position, the mattress 14 being in stowed-away vertical position, and for the seat 41 to occupy a position stowed away or retracted inside the fixed framework 2 and below the cladding plate 19 when the pivoting framework 5 is in its stretched-out position (FIGS. 1, 3 and 5) and the mobile support 23 is in its low retracted position, the mattress 14 being in horizontal position of use.

The space between the mobile support 23, in low retracted position, and the cladding plate 19 of the pivoting framework 5, in stretched-out position, is designed to house the seat 41 therein, in stowed-away position, without crushing or possibly slightly crushing the seat 41.

Figure 3:
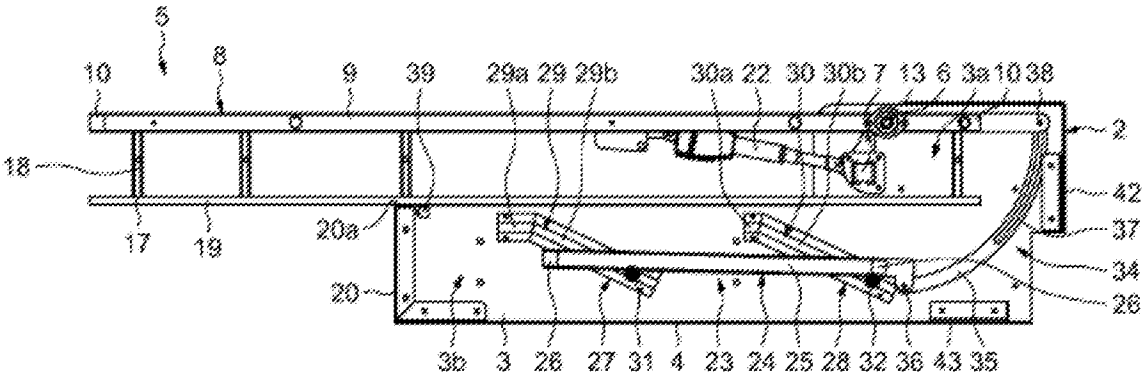
FIG. 3 represents a longitudinal cross section of the bed structure, in stretched-out position, with neither mattress nor seat.

Moreover, the mobile support 23 can be subject to displacement-assisting springs or elastic tensioners 23*a* (FIG. 1) which stress the mobile support from its high advanced position (FIG. 4) to its low retracted position (FIG. 3).

Advantageously, the fixed framework 2 is self-supporting.

For that, the longitudinal position of the cross member 20 linking the front edges of the lateral flanges 3, on which the pivoting framework 5 bears in stretched-out position, must be in front of a position of equilibrium of the torques resulting from the weights or masses of the bed 1, fully equipped, behind and in front of the cross member 20 and the floor supports of the lateral flanges 3, to prevent any forward tilting. For example, the cross member 20 is situated in front of the center of the length of the pivoting framework 5, while remaining fairly distant from the front of the pivoting framework 5. Also, when the pivoting framework 5, fully equipped, is in raised position, the floor supports of the fixed framework 2, in particular given the longitudinal position of the transverse articulation axis 6, prevent any tilting of the bed, backward in particular.

Thus, the bed 1, fully equipped, can be used without the need to fix the fixed framework 2 to the floor or to an adjacent wall and without the need to equip the pivoting framework 5 with front supporting feet.

Advantageously, the following arrangements can be adopted.

The lateral flanges 3 comprise rear parts 3*a* and front parts 3*a* stretched out forward of and lower than the rear parts 3*a*.

The top edges of the front parts 3*b* of the lateral flanges 3 are level with the top edge of the front cross member 20 in the form of a plate.

The rear parts 3*a* of the lateral flanges 3 bear the link cross member 7 and the transverse pivots 13, at levels situated higher than the top edges of the front parts 3*b*.

The top front vertical edges of the rear parts 3*a* of the lateral flanges 3 can be in the area of the lateral extents of the cladding plate 19 when the pivoting framework 5 is in its raised position.

The rear vertical edges of the lateral flanges 3 can be linked by a vertical plate 42.

The bottom edges of the lateral flanges 3 can be linked by a horizontal plate 43.

Cladding plates can be provided. In particular, the pivoting framework 5 can be equipped with lateral plates 44 and a front plate 45, having edges linked to the edges of the cladding plate 19 and edges adjacent to the frame 8 and linked thereto.

The lateral flanges 3 can be equipped, externally, with blocks forming arm rests.

When the pivoting framework 5 is in raised position and the seat 41 is in position of use, a removable backrest (not represented) formed by one or more cushions can be placed against the cladding plate 19.

According to a variant embodiment, a backrest can be fixed against the cladding plate 19. Such a backrest could then be brought, in the forward pivoting of the pivoting framework 5, into a position stowed away above the seat 41 in stowed-away position, and vice versa.

Moreover, the bed can be equipped with lateral plates fixed externally against the lateral flanges and with a top linked to the top ends of these lateral plates. These lateral plates can have a reduced width allowing for the existence of clearances on either side of the bed in stretched-out position and for the placement of bedside tables.

The invention claimed is:

1. A lift-up bed structure comprising:

a fixed framework;

a pivoting framework capable of supporting bedding, mounted to pivot on a transverse pivoting axis in such a way that the pivoting framework can pivot between a horizontal position stretched out forward and a rear vertical raised position;

a mobile support capable of supporting a seat, movably mounted on the fixed framework in such a way that the mobile support can be displaced between a high advanced position and a low retracted position in which it is lower than in the high advanced position; the mobile support, in the high advanced position, extending at least partly in front of the pivoting framework, in the rear vertical raised position, and the mobile support, in the low retracted position, extending at least partly below and at a distance from the pivoting framework, in the horizontal position stretched out forward;

guiding means which determine a travel of the mobile support relative to the fixed framework between its high advanced position and its low retracted position; and link means linking the pivoting framework and the mobile support and capable of displacing the mobile support from its high advanced position to its low retracted position when the pivoting framework is pivoted from its rear vertical raised position to its the horizontal position stretched out forward, and vice versa, along said travel;

wherein the mobile support comprises lateral stringers which are provided laterally with opposing rollers or runners engaged in opposing guides provided on the fixed framework, wherein the link means comprise opposing lateral arms which are arched and articulated on backward of the lateral stringers of the mobile support and having in their lengthwise direction, a travel compensation opening in which are engaged a transverse pivot borne by the pivoting framework, and wherein, when the pivoting framework is pivoted from the stretched-out position to the raised position, in the first portion of angular travel of the pivoting framework, the transverse pivots of the pivoting framework slide along the travel compensation openings of the arched lateral arm from rear ends of these openings to front ends without displacement of the mobile support, and then after the contact of the transverse pivots against the front ends of the compensation openings, in a second portion of angular travel the pivoting framework drives the mobile support from its low retracted position to its advanced position, wherein the arched lateral arms move with respect to the fixed framework during the second portion of angular travel of the pivoting framework.

2. The structure as claimed in claim 1, in which the guides have horizontal front terminal portions.

3. The structure as claimed in claim 1, in which the pivoting framework is equipped with a cladding facing plate, the mobile support, in the low retracted position, extending at least partly below and at a distance from this cladding plate of the pivoting framework, in the horizontal position stretched out forward.

4. The structure as claimed in claim 1, in which the fixed framework comprises a front cross member forming an abutment for the pivoting framework, in the horizontal position stretched out forward.

5. The structure as claimed in claim 1, comprising lateral flanges linked by a reinforcing and anti-torsion cross member situated below and in front of the transverse pivoting axis of the pivoting framework.

* * * * *